US010483654B2

(12) United States Patent
Werntz et al.

(10) Patent No.: US 10,483,654 B2
(45) Date of Patent: Nov. 19, 2019

(54) AXISYMMETRIC THINNED DIGITAL BEAMFORMING ARRAY FOR REDUCED POWER CONSUMPTION

(71) Applicant: The Boeing Company, Chicago, IL (US)

(72) Inventors: Paul C. Werntz, Long Beach, CA (US); Dennis L. Gould, Whittier, CA (US); Patrick K. Bailleul, Whittier, CA (US); Brian M. Park, Torrance, CA (US); Andre C. Houle, Rolling Hills Estates, CA (US); Raenaurd D. Turpin, La Mirada, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 15/888,196

(22) Filed: Feb. 5, 2018

(65) Prior Publication Data

US 2019/0245274 A1 Aug. 8, 2019

(51) Int. Cl.

*H01Q 21/00* (2006.01)
*H01Q 3/38* (2006.01)
*H01Q 21/22* (2006.01)

(52) U.S. Cl.

CPC ..... *H01Q 21/0025* (2013.01); *H01Q 3/38* (2013.01); *H01Q 21/22* (2013.01)

(58) Field of Classification Search

CPC .... H01Q 21/0025; H01Q 21/06; H01Q 21/22; H01Q 25/02; H01Q 3/30; H01Q 3/38
See application file for complete search history.

(56) References Cited

U.S. PATENT DOCUMENTS

| | | | | |
|---|---|---|---|---|
| 6,400,337 | B1 * | 6/2002 | Handelsman | H01Q 7/00 343/742 |
| 6,504,516 | B1 | 1/2003 | Davis | |
| 8,203,483 | B2 | 6/2012 | Richards | |
| 2009/0303125 | A1 | 12/2009 | Caille et al. | |
| 2011/0102263 | A1 | 5/2011 | Angeletti | |

(Continued)

FOREIGN PATENT DOCUMENTS

| | | | |
|---|---|---|---|
| CN | 102521472 | A | 6/2012 |
| CN | 103985970 | A | 8/2014 |

(Continued)

OTHER PUBLICATIONS

Delos, P., "Receiver Design Considerations in Digital Beamforming Phased Arrays", microwaves&rf, Sep. 12, 2014, pp. 1-13, retrieved on Feb. 5, 2018, retrieved from Internet http://mwrf.com/print/components/receiver-design-considerations-digital . . . .

(Continued)

*Primary Examiner* — Hoang V Nguyen
(74) *Attorney, Agent, or Firm* — Coats & Bennett, PLLC

(57) ABSTRACT

An antenna platter comprises a plurality of antenna elements arranged as a thin array according to a polygonal grid. The polygonal grid comprises a plurality of paired polygons arranged symmetrically about a central polygon of the grid. In each polygon of the grid, the plurality of antenna elements is arranged in symmetrical pairs about a center point such that the first and second antenna elements of each symmetrical pair are complex conjugates of one another.

20 Claims, 12 Drawing Sheets

(56) References Cited

U.S. PATENT DOCUMENTS

| | | | |
|---|---|---|---|
| 2016/0315677 A1 | 10/2016 | Angeletti et al. | |
| 2017/0331176 A1 | 11/2017 | Levy et al. | |

FOREIGN PATENT DOCUMENTS

| | | | | |
|---|---|---|---|---|
| JP | 200674191 A * | 3/2006 | ..... | H01Q 25/02 |
| RU | 2170997 C1 * | 7/2001 | ..... | H01Q 21/06 |

OTHER PUBLICATIONS

Radar Basics, "Digital Beamforming", pp. 1-2, retrieved on Feb. 5, 2018, retrieved from Internet http://www.radartutorial.eu/06.antennas/Digital%20Beamforming.en.html.

Numazaki, T. et al., "An Improved Thinning Method for Density Tapering of Planar Array Antennas", IEEE Transactions on Antennas and Propagation, Sep. 1987, pp. 1066-1070, vol. AP-35, No. 9.

* cited by examiner

AXISYMMETRIC THINNED DIGITAL BEAMFORMING ARRAY FOR REDUCED POWER CONSUMPTION

TECHNICAL FIELD

The present disclosure relates generally to the field of antennas and more particularly to digital beamforming antennas.

BACKGROUND

Digital Beamforming (DBF) is a technique for directional signal transmission and reception. Structurally, the architecture of a DBF antenna comprises a plurality of antenna elements (e.g., an "array") distributed about an antenna platter with each antenna element (or groups of antenna elements—e.g., a "sub-array") connected to one of a plurality of transceivers. Signals received at a DBF antenna are detected, down-converted, and digitized at the element and/or sub-array level, and then processed by a digital beam processor to form a desired beam. Noise and distortion are de-correlated among the plurality of transceivers. On the transmit side, the digital beam processor forms a desired antenna beam by summing a plurality of sub-beams formed by each antenna element or sub-array. The digital beam processor is able to digitally "steer" the antenna beam by varying the output of select antenna elements. Thus, with DBF techniques, a focused antenna beam can be transmitted to a receiving station in any direction over a wide angle in front of the array, but without having to physically move the antenna.

BRIEF SUMMARY

Aspects of the present disclosure relate to an antenna platter for a phased array antenna system, and to a corresponding method for designing and constructing an antenna platter for a phased array antenna system. According to the present disclosure, these aspects may be implemented, for example, by a computing device.

In one aspect, a phased array antenna system comprises an antenna platter and a plurality of antenna elements. The plurality of antenna elements is distributed on the antenna platter according to a polygonal grid that comprises a plurality of polygonal pairs. Each polygonal pair comprises first and second polygons arranged symmetrically about a center of the antenna platter. Additionally, the plurality of antenna elements in each polygonal pair is arranged in symmetrical pairs about a center point of the polygon such that the antenna elements of each symmetrical pair are complex conjugates of one another.

In one aspect, the plurality of antenna elements comprises a thinned antenna array. Additionally, a density of the plurality of antenna elements on the antenna platter varies as a function of distance from the center of the antenna platter.

In one aspect, the density of the plurality of antenna elements on the antenna platter decreases as the distance from the center of the antenna platter increases.

In one aspect, a size and a shape of the first and second polygons of each polygonal pair is the same. Further, in one aspect, the first and second polygons of a first polygonal pair are different than the first and second polygons of a second polygonal pair. In such aspects, the first polygon of the first polygonal pair and the first polygon of the second polygonal pair can have different sizes and/or shapes.

In one aspect, the first and second polygons of a first polygonal pair and the first and second polygons of a second polygonal pair, respectively, have the same size and shape. In such aspects, a distribution pattern of the antenna elements in the first polygon of the first polygonal pair is the same as a distribution pattern of the antenna elements in the first polygon of the second polygonal pair.

In one aspect, a distribution of the antenna elements in the first and second polygons of each polygonal pair is a function of a size and a shape of the first and second polygons of each polygonal pair.

In one aspect, the present disclosure provides a method of determining a distribution of antenna elements for a phased array antenna system. In this aspect, the method comprises distributing a plurality of antenna elements on an antenna platter according to a polygonal grid. The polygonal grid comprises a plurality of polygons arranged in polygonal pairs symmetrically about a center of the antenna platter. Further, distributing the plurality of antenna elements comprises, for each polygon in each polygon pair, arranging the plurality of antenna elements in symmetrical pairs about a center point of the polygon such that the antenna elements of each symmetrical pair are complex conjugates of one another.

In one aspect, each symmetrical pair of antenna elements comprises first and second antenna elements, and arranging the plurality of antenna elements in each polygon in symmetrical pair comprises arranging the first and second antenna elements of each symmetrical pair substantially equidistantly from the center point.

In one aspect, the method further thins the plurality of antenna elements such that a density of the plurality of antenna elements on the antenna platter varies as a function of distance from the center of the antenna platter. In such aspects, the density of the plurality of antenna elements on the antenna platter decreases as the distance from the center of the antenna platter increases.

In one aspect, each polygon pair comprises congruent first and second polygons.

In one aspect, the first and second polygons of a first polygonal pair and the first and second polygons of a second polygonal pair are non-congruent. In these aspects, a distribution pattern of the antenna elements in the first polygon of the first polygonal pair is different than a distribution pattern of the antenna elements in the first polygon of the second polygonal pair.

In one aspect, the method also calls for determining one or more sets of polygonal pairs in the polygonal grid. In these aspects, a size and shape of the first and second polygons of each polygonal pair in each set are congruent, respectively. In such aspects, distributing a plurality of antenna elements comprises distributing the antenna elements in the first polygon of each polygonal pair, and the second polygon of each polygonal pair, in a same pattern, respectively.

In one aspect, the present disclosure provides a non-transitory computer readable medium storing a computer program product for controlling a programmable computing device. The computer program product comprises software instructions that, when executed by processing circuitry of the programmable computing device, cause the processing circuitry to determine a distribution of a plurality of antenna elements on an antenna platter according to a polygonal grid comprising a plurality of polygons arranged in polygonal pairs symmetrically about a center of the antenna platter, and then distribute the plurality of antenna elements on the antenna platter. To distribute the plurality of antenna elements, the executing software instructions cause the processing circuitry, for each polygon in each polygon pair, to arrange the plurality of antenna elements in symmetrical pairs about a center point of the polygon such that the antenna elements of each symmetrical pair are complex conjugates of one another.

BRIEF DESCRIPTION OF THE DRAWINGS

Aspects of the present disclosure are illustrated by way of example and are not limited by the accompanying figures with like references indicating like elements.

DETAILED DESCRIPTION

Aspects of the present disclosure relate to the distribution and arrangement of a plurality of antenna elements on a thinned digital beamforming array (DBA), and to the design and manufacture thereof. In more detail, aspects of the present disclosure superimpose a polygonal grid over an antenna platter. The polygonal grid comprises a plurality of polygons arranged as polygonal pairs symmetrically about a center of the platter. In each polygon, the antenna elements are arranged in symmetrical pairs about a center point of the polygon such that the antenna elements of each symmetrical pair are complex conjugates of each other. Distributing the antenna elements in this manner reduces the number of calculations needed to compute beamforming parameters, thereby reducing the digital signal processing computational load and power consumption when the antenna is in use.

Figure 1:
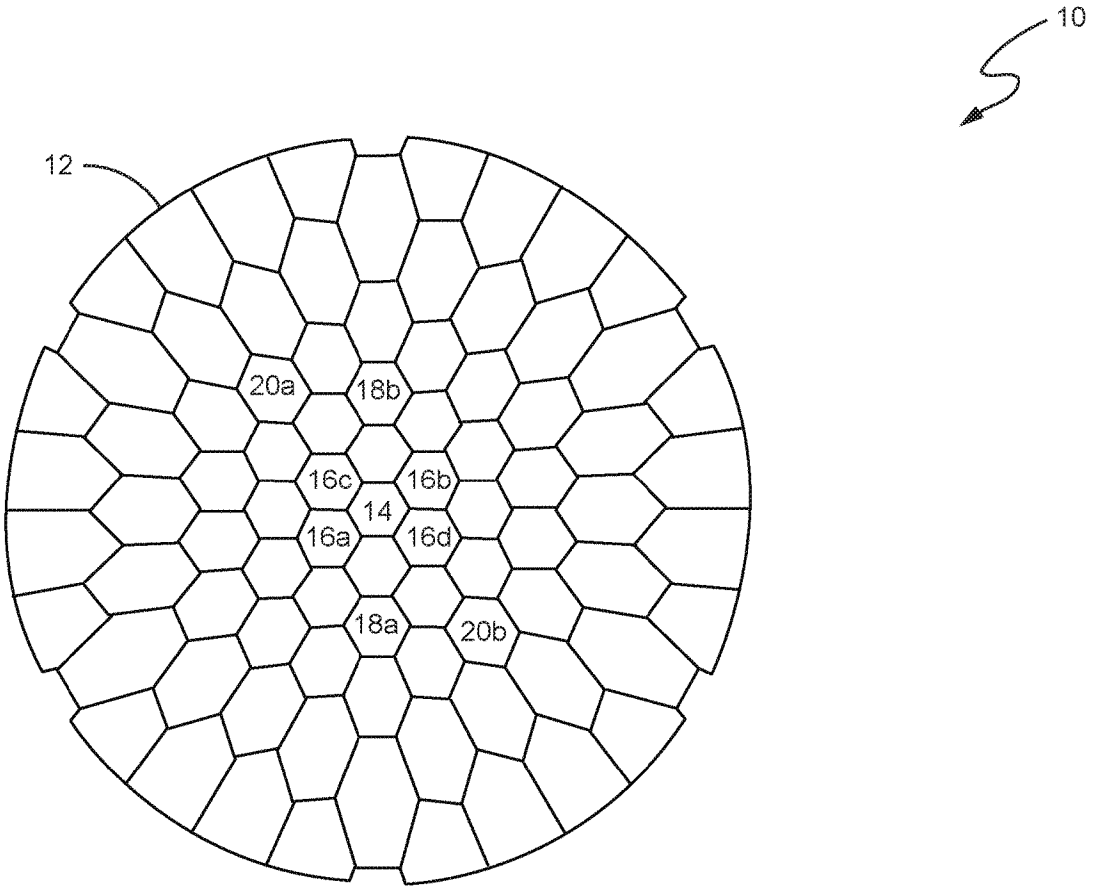
FIG. 1 illustrates an antenna platter for a phased array antenna system and polygonal grid superimposed on the antenna platter according to one aspect of the present disclosure.

Turning to the drawings, FIG. 1 illustrates a polygonal grid 12 superimposed on an antenna platter 10 for a phased array antenna system. As seen in the illustrated aspects, the antenna platter 10 is generally circular in shape; however, those of ordinary skill in the art will appreciate that this is for illustrative purposes only. As the size and/or shape of the antenna platter 10 is not germane to the present disclosure, the aspects described herein are equally as suitable for use with antenna platters 10 having non-circular sizes and/or shapes.

The polygonal grid 12 comprises a central polygon 14 surrounded by a plurality of polygons organized in pairs. Each polygon pair comprises a first polygon (e.g., polygon 16*a*, 16*c*, 18*a*, 20*a*) and a corresponding second polygon (e.g., polygon 16*b*, 16*d*, 18*b*, 20*b*) arranged symmetrically about the central polygon 14. The size and shape of the first polygon 16*a*, 16*c*, 18*a*, 20*a* in each polygon pair is substantially identical in size and shape to its corresponding second polygon 16*b*, 16*d*, 18*b*, 20*b* in the pair. That is, the first and second polygons (e.g., 16*a*, 16*b*) in each polygon pair are "congruent."

In more detail, "congruent," as used herein, means that the size and shape (e.g., form) of two or more polygons (e.g., the polygons of a polygon pair) are substantially identical such that the polygons substantially coincide with each other when superimposed with one another. For example, in FIG. 1, polygon 16*a* is paired with polygon 16*b* and situated on diametrically opposite sides of central polygon 14. Polygon 16*a* has substantially the same size and shape as polygon 16*b*, and thus, polygons 16*a* and 16*b* are considered "congruent."

Generally, the sizes and shapes of the first and second polygons in a given first polygon pair (e.g., 16*a*, 16*b*, referred to herein collectively as 16-1) are different than the sizes and shapes of the first and second polygons in a given second polygon pair (e.g., 20*a*, 20*b*, referred to herein collectively as 20). That is, respective first and second polygons of different polygonal pairs are "non-congruent." As used herein, the term "non-congruent" means that two or more polygons have at least one of a different size or a different shape.

However, non-congruency is not always the case. In some aspects of the disclosure, the sizes and shapes of the first and second polygons (e.g., 16*a*, 16*b*) in a first polygon pair (e.g., polygon pair 16-1) are substantially congruent, respectively, to the first and second polygons in a second polygon pair (e.g., polygons 16*c*, 16*d*, referred to herein collectively as 16-2). That is, in certain aspects, not only are the individual polygons that comprise a given polygonal pair congruent, but those same polygons could also be congruent to the individual polygons comprising a second polygonal pair.

As described in more detail later, aspects of the present disclosure beneficially utilize this "congruency" characteristic to determine distribution patterns for the antenna elements across the antenna platter 10 in a manner that reduces both the computational load needed for computing beamforming parameters, and the power that is consumed by antenna platter 10. For example, some aspects of the present disclosure will first analyze the polygonal grid 12 to identify a "representative set" of polygons. Each polygon in the representative set is unique in size and shape from all the other polygons in the representative set. However, while not required, each polygon in the representative set can also be congruent with one or more other polygons that are not in the representative set. In these aspects, a distribution pattern for the antenna elements in each of the polygons comprising the representative set is first determined. Then, those distribution patterns are copied or "cloned" to other polygons in the polygonal grid 12 based on congruency. Such cloning is beneficial because fewer design and manufacturing steps are needed than if the distribution pattern for each polygon in the polygonal grid 12 were not cloned.

Figure 2:
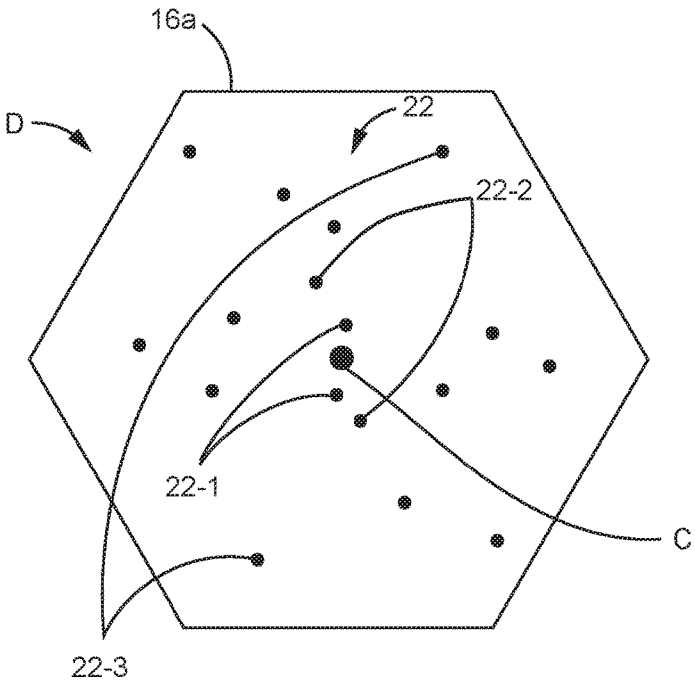
FIG. 2 illustrates a distribution of antenna elements in a polygon of the polygonal grid according to one aspect of the present disclosure.

FIG. 2 illustrates a distribution pattern D of antenna elements 22 in a representative polygon 16*a* according to one aspect of the present disclosure. As shown in FIG. 2, a plurality of antenna elements 22 are arranged as symmetrical pairs 22-1, 22-2, 22-3 about a center point C. For example, antenna elements 22-1 are corresponding antenna elements. So, too, are corresponding antenna elements 22-2 and 22-3. Each symmetrical pair 22-1, 22-2, 22-3 comprises a first antenna element and a corresponding second antenna element positioned substantially equidistant from center point C. This physical symmetrical arrangement of the first and second antenna elements in each symmetrical pair 22-1, 22-2, 22-3 means that the first and second antenna elements are arranged such that they are complex conjugates of each other. For example, in this aspect, the positions of the first and second antenna elements in a given polygon of polygonal grid 12 are based on real and imaginary values in beam forming calculations associated with the first and second antenna elements.

Particularly, the first and second antenna elements of a given symmetrical pair (e.g., symmetrical pair 22-1) are defined by complex numbers having an equal magnitude real part and an equal magnitude, but opposite sign, imaginary part. For example, if the complex number defining the first antenna element in symmetrical pair 22-1 is expressed as 2+5i, then the second antenna element of symmetrical pair 22-1 is the complex conjugate of 2+5i, which is 2−5i. Thus, to find the complex conjugate of any given first antenna element of a given symmetrical pair, aspects of the present disclosure simply change the sign of the imaginary part from '+' to '−' (or, alternatively, from '−' to '+').

In one aspect, the complex conjugate relationship of symmetrical pairs within a given polygon, such as symmetrical pairs 22-1, 22-2, 22-3 in polygon 16*a*, is maintained by combining the signals from the antenna elements 22 in each polygon within the polygonal grid 12. For example, in one aspect, the signals are combined using, for example, information received from a network, or by using any of a variety of known processing techniques (e.g., digital signal processing techniques) that provide true time delay adjustment of the arrival time of the signals. A single true time delay value is used for all antenna elements 22 within each polygon. In one aspect, signals from antenna elements 22 within each polygon are also phase adjusted before or after applying the true time delay adjustment.

Because the distributed antenna elements are symmetrically arranged as complex conjugates of each other, aspects of the present disclosure do not require the beamforming calculations to be performed for each antenna element. Rather, the calculations for determining the beamforming parameters are performed for only one of the antenna elements in the pair. Once the calculations are complete for that antenna element, the present disclosure needs only to compute the complex conjugate of the antenna element by changing the sign of the imaginary part to obtain the beamforming parameters for the other antenna element in the symmetrical pair. Such mathematical operations are less computationally expensive than if the same beamforming calculations were to be performed individually for each antenna element (e.g., there are fewer calculations required to calculate the beamforming parameters than compared to other beamforming calculation techniques that require the calculations to be performed for each element individually).

It should be noted that the size and shape of polygon 16*a* seen in FIG. 2, as well as the particular distribution and positioning of the symmetrical pairs of antenna elements 22 within polygon 16*a*, are for illustrative purposes only. So, too, is the number of antenna elements 22 and illustrated positioning of the symmetrical pairs of antenna elements 22. In practice, the aspects described in connection with polygon 16*a* and FIG. 2 are equally as applicable to any other polygon in the polygonal grid 12. As described later in more detail, the number of antenna elements 22, and thus, the number of symmetrical pairs of antenna elements 22, can vary depending on design requirements. However, in some aspects, the density of antenna elements 22 is highest nearest the center of the antenna platter 10.

According to the present disclosure, the particular distribution and arrangement of the antenna elements 22 on antenna platter 10 can be determined by a computing device prior to manufacture of the antenna platter 10. The antenna platter 10 is then constructed in accordance with the determined distribution pattern D.

In particular, aspects of the present disclosure begin the design process with a very dense array of antenna elements 22 distributed over the antenna platter 10. In one aspect, the distribution of antenna elements 22 is random or pseudo-random. The array of antenna elements 22 is then thinned by applying, for example, a Taylor Thinning process. The process of thinning strategically eliminates some of the antenna elements 22 to produce a radiation pattern having a low side lobe level (SLL). For example, in one aspect, the initial distribution of antenna elements 22 after thinning is such that each polygon of the polygonal grid 12 has between approximately 40-130 antenna elements. The polygonal grid 12 is then superimposed over the antenna platter 10.

Once thinning has been applied, this random or pseudo-random distribution and arrangement of antenna elements 22 is replaced with a new distribution and arrangement of antenna elements 22 such that the total number of antenna elements 22 polygonal grid 12, as well as the number of antenna elements 22 in each polygon of polygonal grid 12 is substantially the same. However, the number of antenna elements 22 in the "fractional" polygons (i.e., those polygons disposed at a periphery of polygonal grid 12) can be proportionally reduced based on size.

To accomplish this distribution, one aspect of the present disclosure re-shapes and/or re-sizes each of the polygons in grid 12, prior to removing the thinned array, to ensure that each polygon in grid 12 encompasses substantially the same number of antenna elements 22. Then, once the thinned array has been removed, the new distribution of antenna elements 22 is arranged in each polygon of grid 12 in symmetrical pairs. Particularly, the first and second antenna elements of each symmetrical pair are arranged about the center point C of the polygon such that the antenna elements 22 of each symmetrical pair are complex conjugates of each other, as previously described.

The number of antenna elements 22 per polygon need not be exact; however, the number of antenna elements 22 in each polygon should be substantially equal based on polygon size and congruency. For example, in one aspect, the number of antenna elements 22 per polygon is between about 50 antenna elements per polygon and about 110 antenna elements per polygon. Larger polygons in polygonal grid 12 can have more antenna elements 22 than the smaller polygons or the "peripheral" polygons; however, polygons of similar size and shape have substantially the same number of antenna elements 22. Having a substantially unequal number of antenna elements 22 distributed in each polygon of polygonal grid 12 could indicate that the re-sizing and re-shaping of the polygons was performed incorrectly.

Regardless of the particular number and arrangement, antenna elements 22 are distributed over the antenna platter 10 such that the density of antenna elements 22 varies as a function of distance from the center of the antenna platter 10. Accordingly, the density of antenna elements 22 on the antenna platter 10 is greatest nearer the center of the antenna platter 10, and decreases as the distance from the center of the antenna platter 10 increases. In certain aspects, the sizes of the polygons in grid 12 also increase with the distance from the center of the antenna platter 10. The increasing size of the polygons allows the polygons that are positioned farther away from the center of antenna platter 10 to contain about the same number of antenna elements as those polygons that are positioned on the grid 12 closer to the center of antenna platter 10.

Figure 3B:
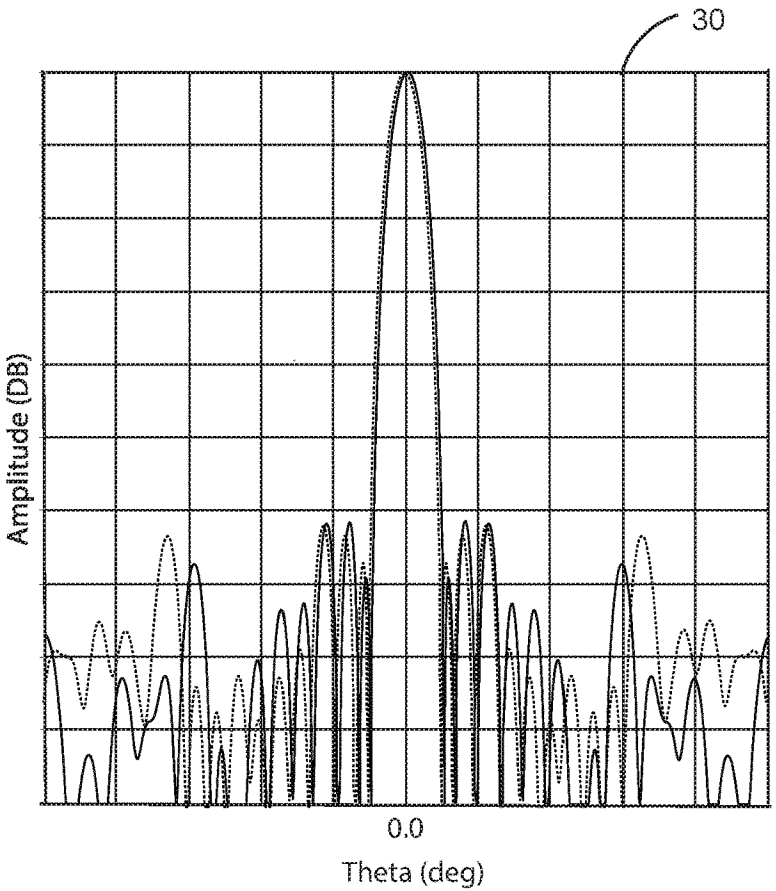
FIGS. 3A-3B illustrate radiation patterns of a phased array antenna having an antenna platter configured according to aspects of the present disclosure.
Figure 3A:
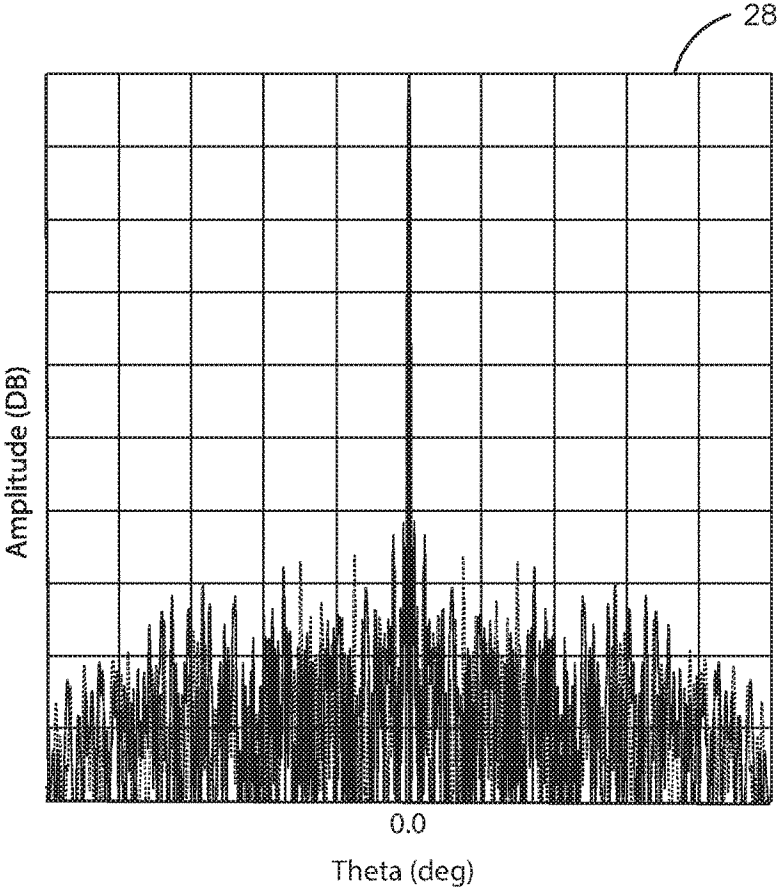

FIGS. 3A-3B illustrate radiation patterns for a phased array antenna system having an antenna platter 10 configured in accordance with aspects of the present disclosure. Particularly, the radiation pattern illustrated in graph 28 of FIG. 3A shows a pronounced main beam represented by the "spike" at 0.00 degrees, flanked on both sides by relatively low SLLs. Thus, the radiation in the direction of the main beam is high, while radiation in unwanted directions of the side lobes is low. Graph 30 of FIG. 3B illustrates the same radiation pattern as that of FIG. 5A, but is focused on a smaller angle (±n degrees from center). Regardless, however, the main beam represented by the spike at 0.0 degrees in FIG. 3B is pronounced, while the SLLs on either side of the main beam are diminished. Wth additional filtering, if desired, the SLL radiation can be reduced to an even greater extent, and in some cases, effectively eliminated.

Figure 4:
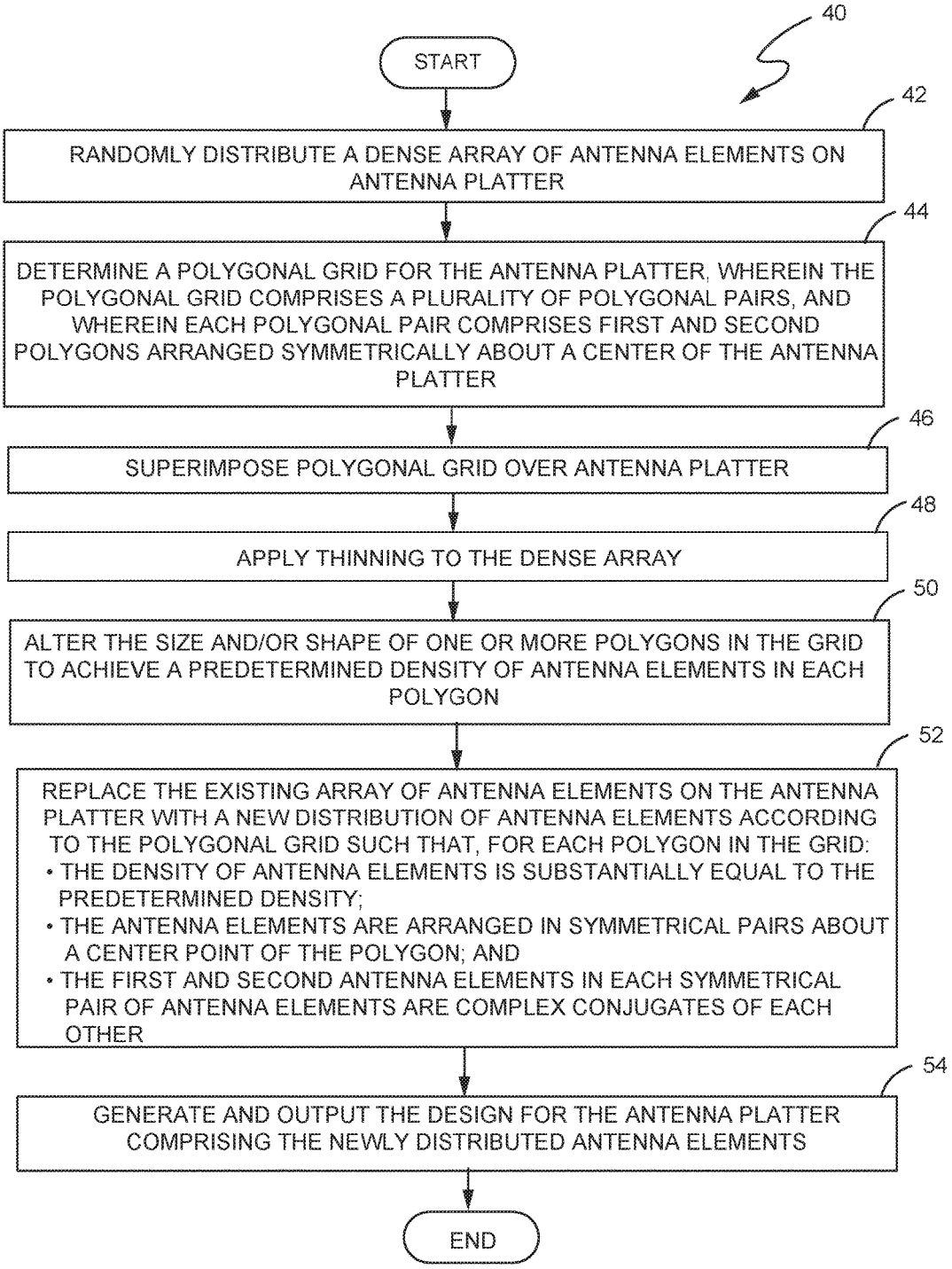
FIG. 4 is a flow diagram illustrating a method for determining a distribution pattern for a plurality of antenna elements over an antenna platter according to aspects of the present disclosure.

FIG. 4 is a flow diagram illustrating a method 40 for determining a distribution pattern D for a plurality of antenna elements 22 on an antenna platter 10 according to one aspect of the present disclosure. As seen in more detail later, method 40 is implemented by a computing device, such as a workstation or network-based server, for example, executing a software design tool comprising a control application program.

As seen in FIG. 4, method 40 begins by randomly or pseudo-randomly distributing a plurality of antenna elements 22 on antenna platter 10. This initial distribution provides a very dense array of antenna elements 22 (box 42). Once distributed, method 40 determines a polygonal grid 12 (box 44) and superimposes the polygonal grid 12 over the antenna platter 10 (box 46). The polygonal grid 12 comprises a plurality of polygons arranged in a plurality of polygonal pairs. Each polygonal pair comprises first and second congruent polygons arranged symmetrically about the center of the antenna platter 10 (e.g., about the central polygon 14). Method 40 then applies a thinning algorithm to the very dense array to thin the number of antenna elements 22 on the antenna platter 10 (box 48). As previously stated, the process of thinning strategically eliminates some of the antenna elements 22 in the array such that the remaining antenna elements produce a radiation pattern having a low side lobe level (SLL).

Method 40 then calls for altering the size and/or shape of one or more of the polygons in the grid 12 to achieve a predetermined density of antenna elements 22 in each polygon (box 50). Although any density needed or desired is possible with the present disclosure, one aspect calls for a predetermined density of between about 50-110 antenna elements 22 per polygon. As shown in the figures, the density of the antenna elements 22 is greater towards the center of the antenna platter 10 than it is towards the periphery of the antenna platter 10. Accordingly, in one aspect, the sizes of the polygons increase with the distance from the center of the antenna platter 10. The increasing size allows the polygons that are closer to the periphery of antenna platter 10 to encapsulate about the same number of antenna elements 22 as those polygons nearer the center of the antenna platter, thereby maintaining the predetermined density of antenna elements 22 per polygon.

Once the polygons in polygonal grid 12 have been sized and shaped, method 40 removes the current distribution of antenna elements 22, and replaces that distribution with a new distribution of antenna elements 22 (box 52). Particularly, the plurality of antenna elements 22 is distributed in each polygon of the polygonal grid 12 such that:

- the density of antenna elements 22 newly distributed in each polygon of the grid 12 remains substantially similar to the predetermined density;
- the antenna elements 22 are arranged in each polygon in symmetrical pairs about the center point C of the polygon; and
- the first and second antenna elements 22 in each symmetrical pair are complex conjugates of each other.

As previously stated, arranging the antenna elements 22 in symmetrical pairs about the center of a polygon, in which the first and second antenna elements 22 are complex conjugates of each other, reduces the number of calculations needed to compute beamforming parameters during operations using digital signal processing. Therefore, the distribution method of the present disclosure beneficially reduces the digital signal processing computational load and power consumption when the antenna is in use.

Once the distribution pattern D of the antenna elements 22 has been determined, method 40 generates and outputs the design for the antenna element distribution and arrangement for the user (box 54). In one aspect, the design is output to a display device to be viewed by the user, while in other aspects, the design is stored to a memory device (e.g., a database) for later use in the manufacturing process. For example, in one aspect, the design generated by the aspects of the present disclosure is used as a template for creating a physical antenna platter 10.

Aspects of the present disclosure, therefore, beneficially reduce the resources needed for operating a system equipped with an antenna platter 10 configured according to the present disclosure. Additionally, however, aspects of the present disclosure also contemplate a method for facilitating the manufacture of such antenna platters 10. More particularly, based on the size and shape of each polygon in the grid 12, aspects of the present disclosure reduce the number of polygons to consider when determining the distribution and arrangement of the antenna elements 22 on antenna platter 10. So reduced, aspects of the disclosure determine a new distribution pattern D for the antenna elements 22, but only for the reduced number of polygons. Once the new distribution is determined for the reduced number of polygons, the present disclosure simply clones the distribution patterns D for the remaining polygons in the polygonal grid 12. Thus, the amount of processing that is required to determine the distribution and arrangement of antenna elements 22 in each polygon of grid 12 is greatly reduced.

Figure 5:
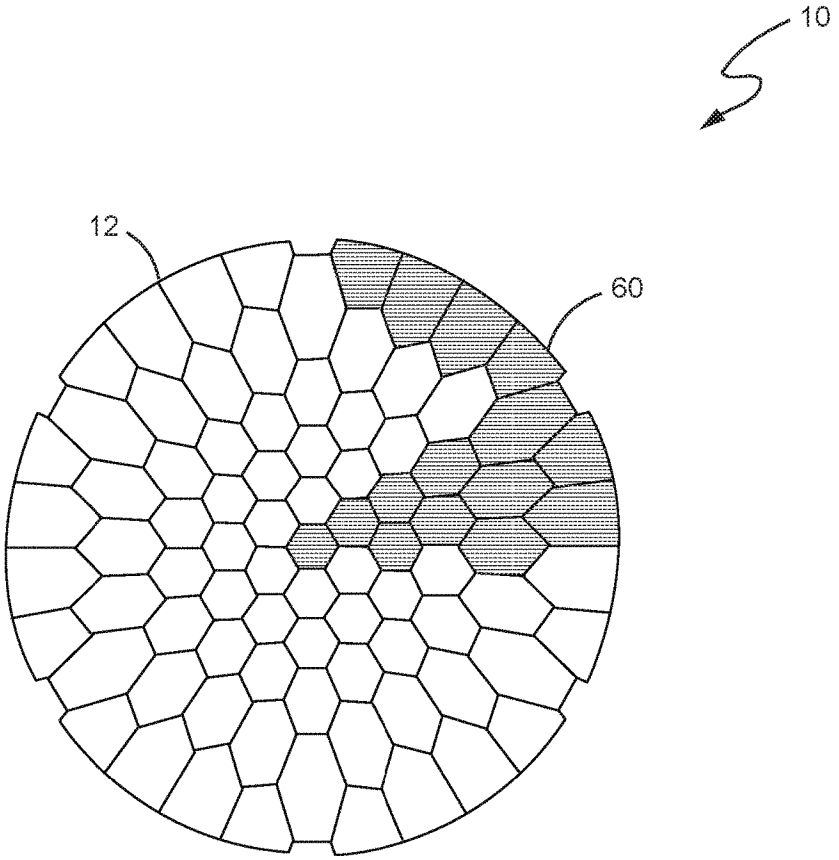
FIG. 5 illustrates a polygonal grid used to facilitate the manufacturing of an antenna platter according to one aspect of the present disclosure.

As seen in FIG. 5, for example, one aspect of the present disclosure compares the sizes and shapes of each polygon in the polygonal grid 12. Based on the results of this comparison, a computing device implementing the method can identify a representative subset of polygons 60. In the aspect of FIG. 5, the representative subset of polygons 60 comprises 15 polygons, including the central polygon 14. Each polygon in the representative subset 60 has a unique size and shape. That is, none of the polygons in the representative subset 60 are congruent. However, with the possible exception of the central polygon 14, each polygon in the representative subset 60 is congruent with at least one other polygon in grid 12 that is not included in representative subset 60. Thus, in accordance with one aspect of the present disclosure, the computing device needs only to determine a distribution pattern D of antenna elements 22 for each polygon that is in the representative subset 60. Once the distribution patterns D for all the polygons in subset 60 are determined, the computing device clones the determined distribution patterns D to the remaining polygons in the grid 12 based on congruency.

Thus, aspects of the present disclosure beneficially utilize the knowledge that the sizes and shapes of some polygons in grid 12 will be substantially identical to the sizes and shapes of other polygons in grid 12 to reduce the complexity in the manufacturing of antenna platter 10. That is, by identifying such "uniquely" sized and shaped polygons in grid 12, and by cloning the distribution patterns D of antenna elements 22 in these "unique" polygons, aspects of the present disclosure greatly reduce the number of patterns that must be determined for the antenna platter 10 as a whole. The reduction in the number of patterns, in turn, greatly reduces the complexity of manufacturing the antenna platters 10.

Figure 6B:
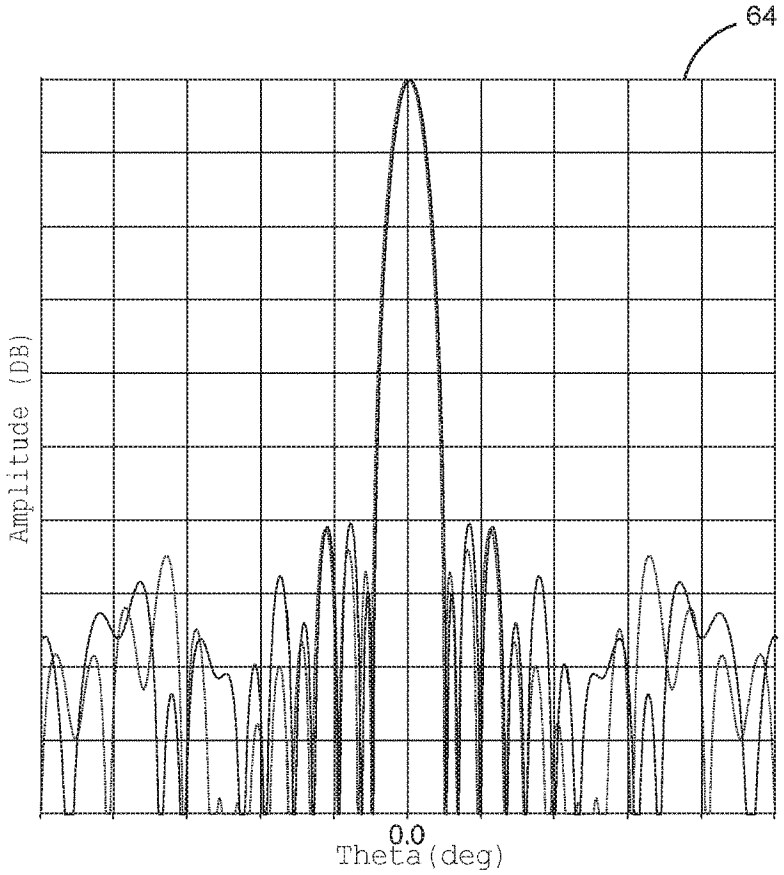
FIGS. 6A-6B illustrate radiation patterns of a phased array antenna system having an antenna platter configured according to the aspect of FIG. 5.
Figure 6A:
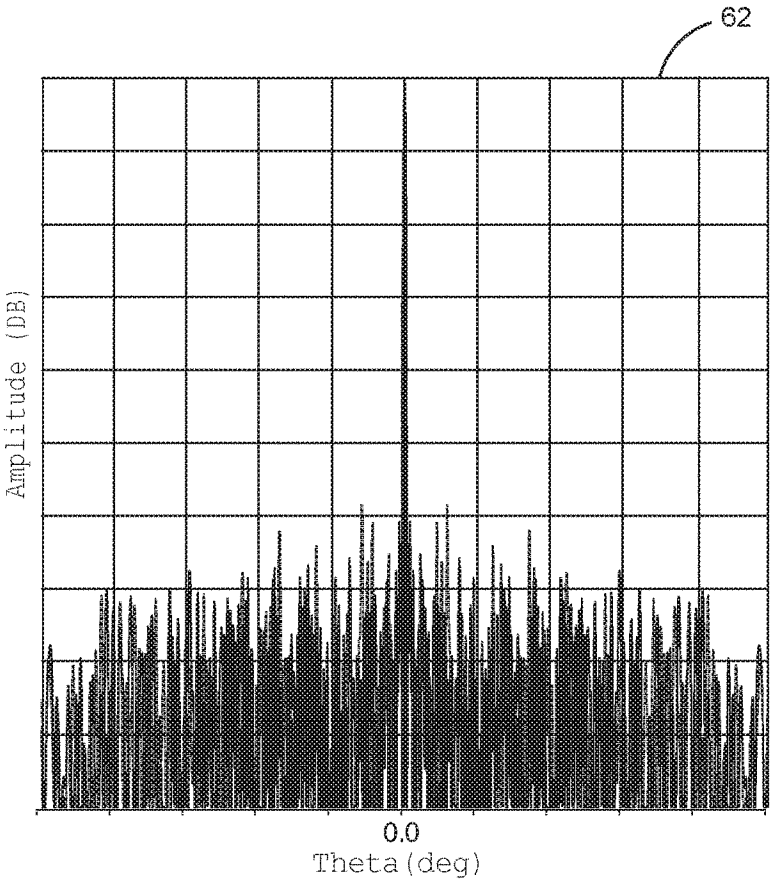

Even with such reductions, the radiation patterns of the antenna platter 10 are not substantially adversely affected. As seen in the graphs 62, 64 of FIGS. 6A-6B, for example, the radiation patterns of the side lobes on either side of the main lobes, which again are represented by the "spikes" at 0.0 degrees, are slightly higher. In various aspects, suitable filtering can be employed to reduce or eliminate the side lobe radiation, thereby leaving the directed radiation pattern for the main lobe.

Figure 7A:
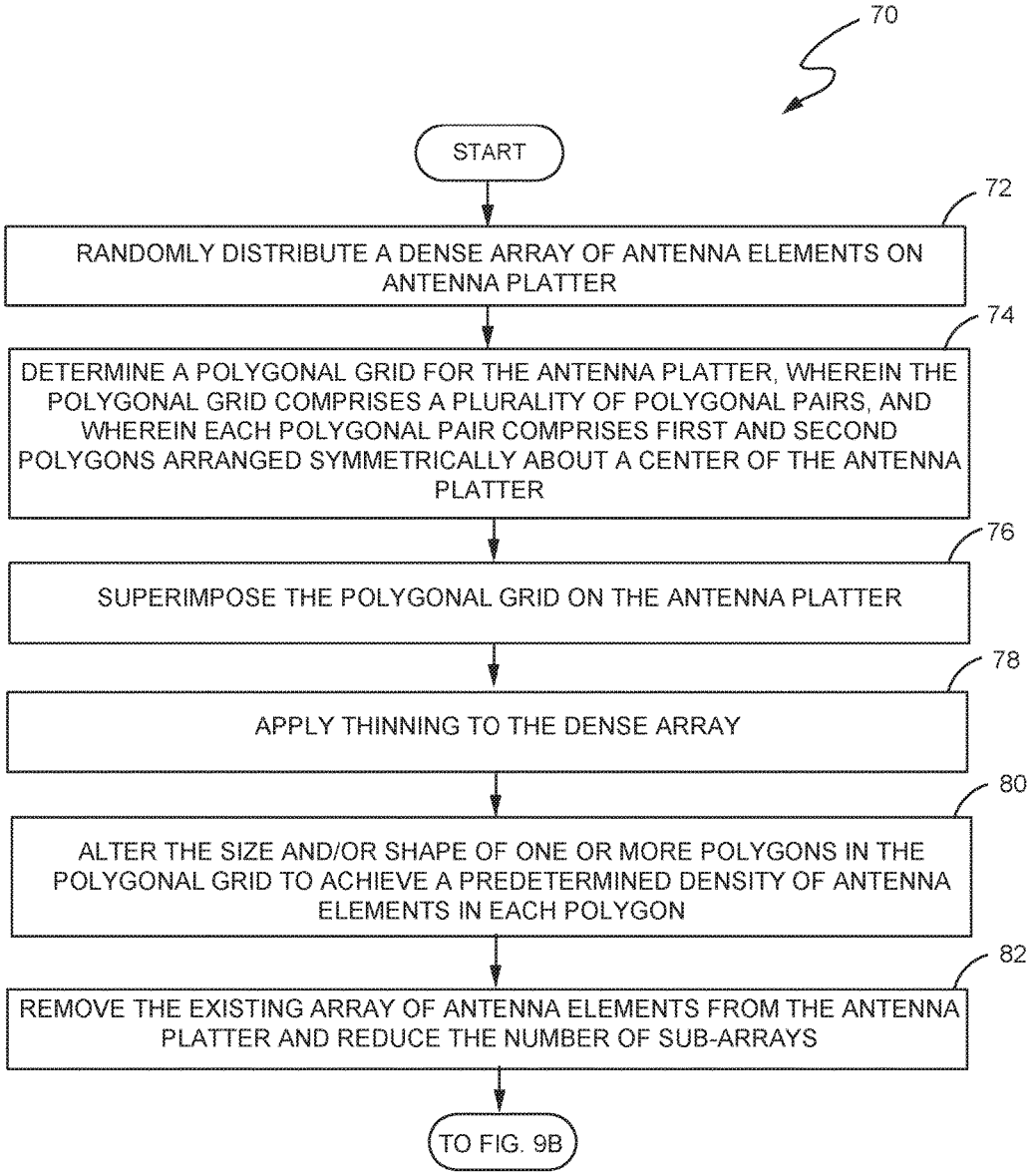
FIGS. 7A-7B are flow diagrams illustrating a method for determining a distribution pattern for a plurality of antenna elements over an antenna platter according one aspect of the present disclosure.
Figure 7B:
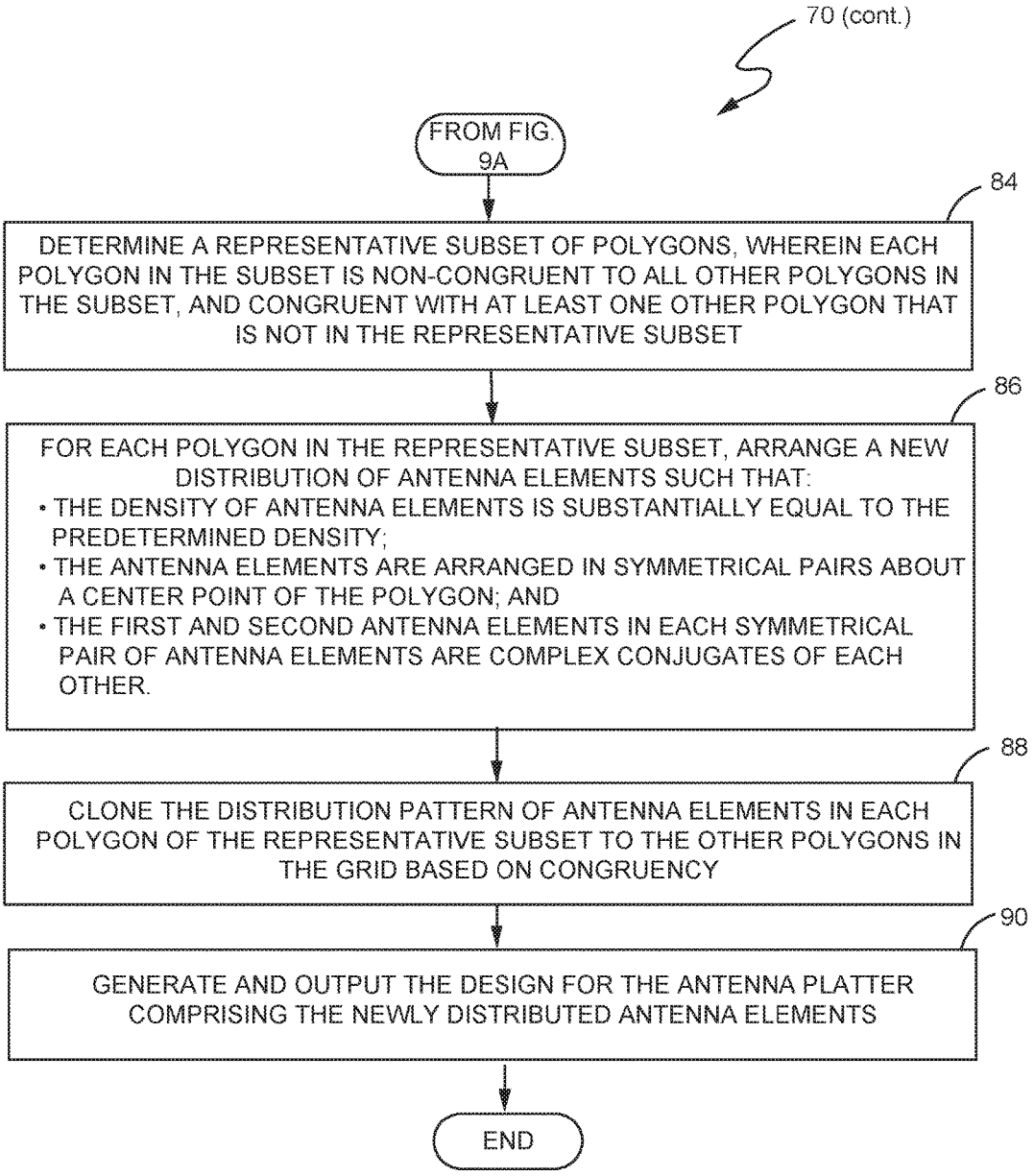

FIGS. 7A-7B are flow diagrams illustrating a method 70 for determining the distribution patterns D of antenna elements 22 for an antenna platter 10 by reducing the number of polygons (i.e., "sub-arrays") for processing according to one aspect of the present disclosure. As discussed above, method 70 is implemented by a computing device and outputs a design specifying the distribution and arrangement of antenna elements 22 for antenna platter 10 that is utilized during a manufacturing process to construct a physical antenna platter 10.

Method 70 begins in a manner similar to that of method 40. Particularly, method 70 randomly distributes a plurality of antenna elements 22 over an antenna platter 10 and generates the polygonal grid 12 for the antenna platter 10 (boxes 72, 74). As previously described, grid 12 comprises a plurality of polygonal pairs, with each polygonal pair comprising first and second congruent polygons (i.e., having substantially the same size and shape). Additionally, each polygonal pair is arranged symmetrically about the central polygon 14 of grid 12. The polygonal grid 12 is then superimposed over the antenna platter 10 (box 76), and the antenna elements 22 are then thinned (box 78). The shape and/or size of one or more of the polygons is then adjusted to achieve a predetermined distribution of antenna elements 22 (box 80). The existing array of antenna elements 22 is then removed and the number of polygons (e.g., sub-arrays) is reduced for processing (box 82).

One process for reducing the number of polygons for consideration is illustrated in FIG. 7B. As seen in this aspect, the computing device implementing method 70 first determines a representative set of polygons 60 (box 84). Each polygon in this representative subset of polygons 60 is non-congruent with all other polygons in the representative subset 60. Thus, each polygon in the representative subset of polygons 60 has a unique size and shape. However, other than the central polygon 14, each polygon in the representative subset of polygons 60 is congruent with at least one other polygon in grid 12 that is not included in the representative subset of polygons 60. Knowledge about the congruency between polygons in grid 12 permits the computing device implementing method 70 to determine an antenna element distribution pattern D for a minimal number of polygons (e.g., those polygons in the representative subset of polygons 60) (box 86), and then clone those determined patterns to the remainder of the polygons in grid 12 (box 88).

Particularly, for each polygon in the representative subset of polygons 60, the antenna elements 22 are distributed as a plurality of symmetrical pairs (e.g., 22-1, 22-2, 22-3 of FIG. 2). Each symmetrical pair comprises first and second antenna elements arranged about a center point C of the polygon and are complex conjugates of each other. In one aspect, the first and second antenna elements 22 in each symmetrical pair are equidistant from the center point C of the polygon, as was illustrated in FIG. 2.

Once the pattern for each polygon in the representative subset of polygons 60 is determined, method 70 clones that pattern to all other polygons in grid 12 based on congruency (box 88). Particularly, for each individual polygon in the representative subset of polygons 60, method 70 clones the distribution and arrangement of the antenna elements 22 in that polygon to all other polygons in polygonal grid 12 that are not in the representative subset of polygons 60, but are nevertheless congruent with that polygon. Such cloning negates the need to determine an antenna element distribution patterns D for each polygon in polygonal grid 12 individually. Method 70 then generates and outputs the design for the antenna platter 10 comprising the newly distributed antenna elements 22 so that the antenna platters 10 can be manufactured based on the design (box 90).

Figure 8:
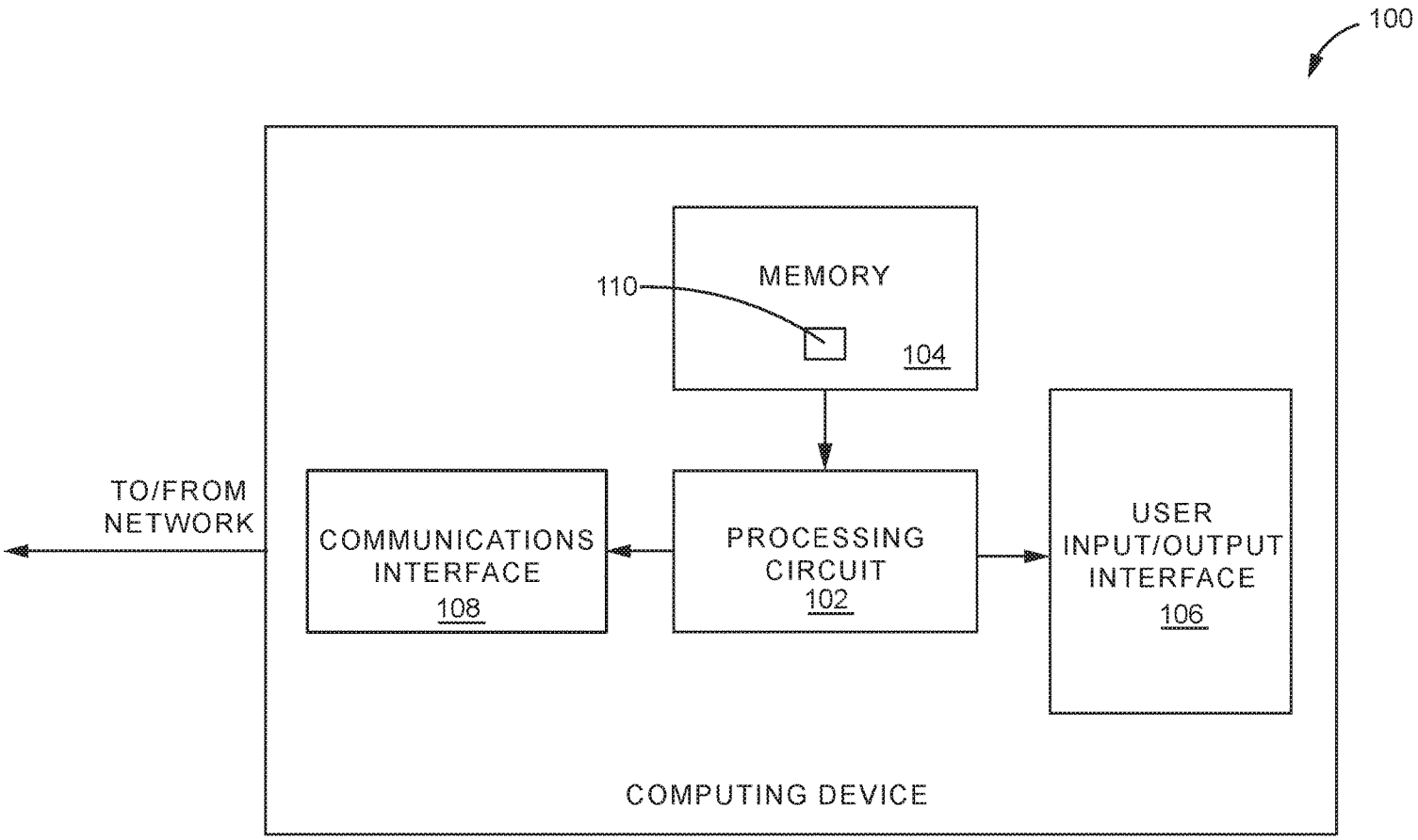
FIG. 8 is a functional block diagram illustrating a computing device configured to determine the distribution patterns of the antenna elements according to aspects of the present disclosure.

FIG. 8 is a block diagram illustrating a computing device 100 configured to determine the distribution pattern D of antenna elements 22 on antenna platter 10 according to the present disclosure. As seen in FIG. 8, computing device 100 comprises processing circuitry 102 communicatively coupled via one or more buses to a memory 104, a user input/output interface 106, and a communications interface 108. According to various aspects of the present disclosure, processing circuitry 102 comprises one or more microprocessors, microcontrollers, hardware circuits, discrete logic circuits, hardware registers, digital signal processors (DSPs), field-programmable gate arrays (FPGAs), application-specific integrated circuits (ASICs), or a combination thereof. In one such aspect, the processing circuitry 102 includes programmable hardware capable of executing software instructions stored, e.g., as a machine-readable computer control program 110 in memory 104. More particularly, processing circuitry 102 is configured to execute control program 110 to perform the aspects of the disclosure previously described.

Memory 104 comprises any non-transitory machine-readable storage media known in the art or that may be developed, whether volatile or non-volatile, including (but not limited to) solid state media (e.g., SRAM, DRAM, DDRAM, ROM, PROM, EPROM, flash memory, solid state drive, etc.), removable storage devices (e.g., Secure Digital (SD) card, miniSD card, microSD card, memory stick, thumb-drive, USB flash drive, ROM cartridge, Universal Media Disc), fixed drive (e.g., magnetic hard disk drive), or the like, individually or in any combination. As seen in FIG. 8, memory 104 is configured to store a computer program product (e.g., the control program 110) executed by processing circuitry 102 to perform the aspects of the present disclosure.

The user input/output interface 106 comprises circuitry configured to control the input and output (I/O) data paths of the computing device 100. The I/O data paths include data paths for exchanging signals with other computers and mass storage devices over a communications network (not shown), and/or data paths for exchanging signals with a user. In some aspects, the user I/O interface 106 comprises various user input/output devices including, but not limited to, one or more display devices, a keyboard or keypad, a mouse, and the like.

The communications interface 108 comprises circuitry configured to allow the computing device 100 to communicate data and information with one or more remotely located computing devices. Generally, communications interface 108 comprises an ETHERNET card or other circuit specially configured to allow computing device 100 to communicate data and information over a computer network. However, in other aspects of the present disclosure, communications interface 108 includes a transceiver configured to send and receive communication signals to and from another device via a wireless network.

Figure 9:
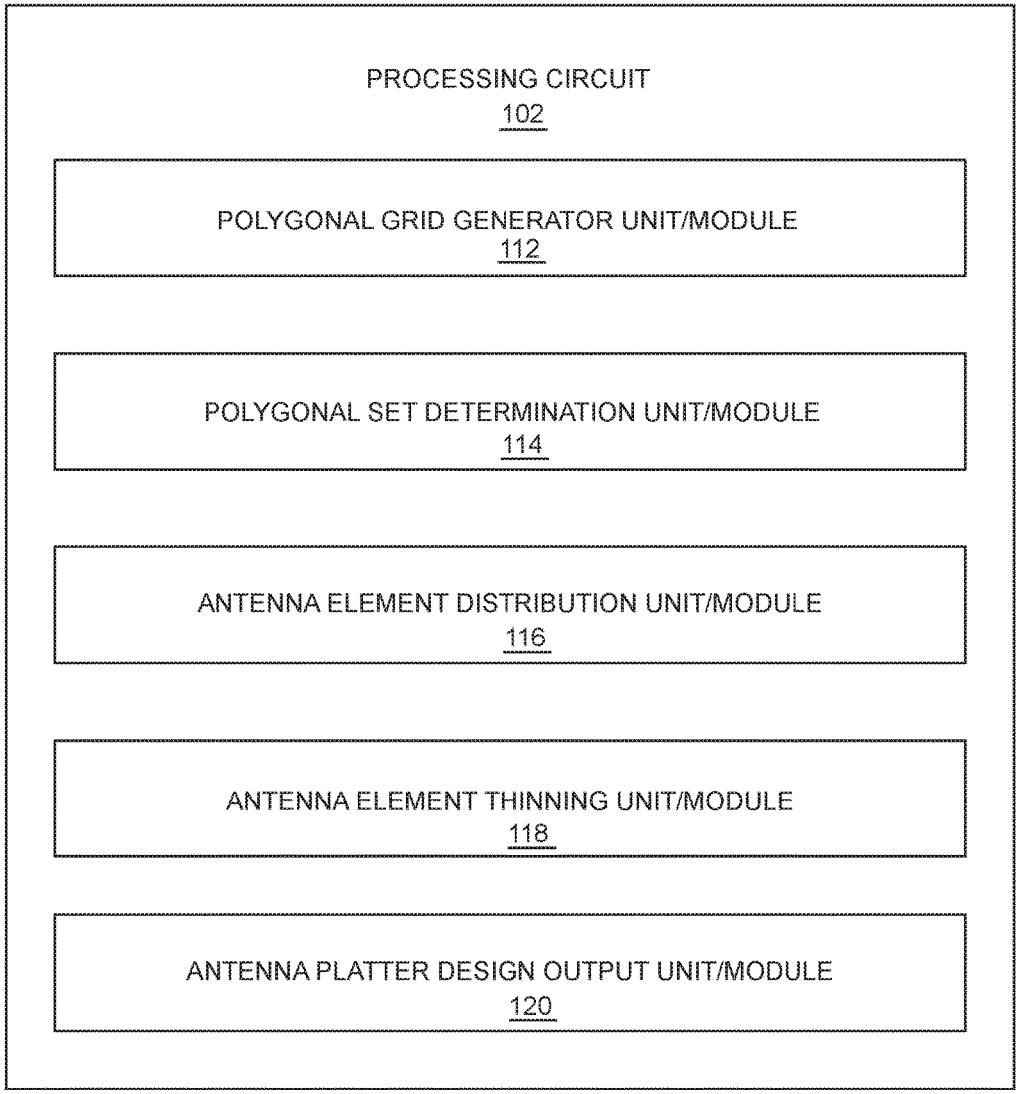
FIG. 9 is a functional block diagram illustrating processing circuitry configured to implement aspects of the present disclosure.

FIG. 9 is a block diagram illustrating processing circuitry 102 implemented according to different hardware units and software modules (e.g., as control program 110 store on memory 104) according to one aspect of the present disclosure. As seen in FIG. 9, processing circuitry 102 implements a polygonal grid generator unit/module 112, a polygonal set determination unit/module 114, an antenna element distribution unit/module 116, an antenna element thinning unit/module 118, and an antenna platter design output unit/module 120.

The polygonal grid generator unit/module 112 is configured to generate the polygonal grid 12 that is superimposed on the antenna platter 10. The polygonal set determination unit/module 114 is also configured to analyze the polygonal grid 12 and identify the set of polygons in the polygonal grid 12 comprising the representative subset of polygons 60 previously described. The antenna element distribution unit/module 114 is configured to determine the distribution patterns D for the antenna elements 22 in each polygon of the grid 12. Particularly, the antenna element distribution unit/module 114 determines the first and second antenna elements 22 for each of a plurality of symmetrical pairs of antenna elements 22 in each polygon, as well as the positions of those first and second antenna elements 22, symmetrically about the center point C of the polygon. In cases where the number of polygons is reduced to facilitate manufacturing the antenna platters 10, the antenna element distribution unit/module 114 determines an antenna element 22 distribution pattern D for each non-congruent polygon in representative subset 60, and then clones those determined patterns to the remaining polygons in grid 12 based on congruency, as previously described.

The antenna thinning unit/module 118 is configured to apply a thinning algorithm to the antenna elements on the antenna platter 10 such that the distribution of the antenna elements 22 on the antenna platter 10 varies as a function of distance from the center of the antenna platter 10. The antenna platter design output unit/module 120 is configured to output the design of the antenna platter 10 for a user. As previously described, the designs that are output by the aspects of the present disclosure are utilized, in some aspects, to manufacture the physical antenna platters 10.

Figure 10:
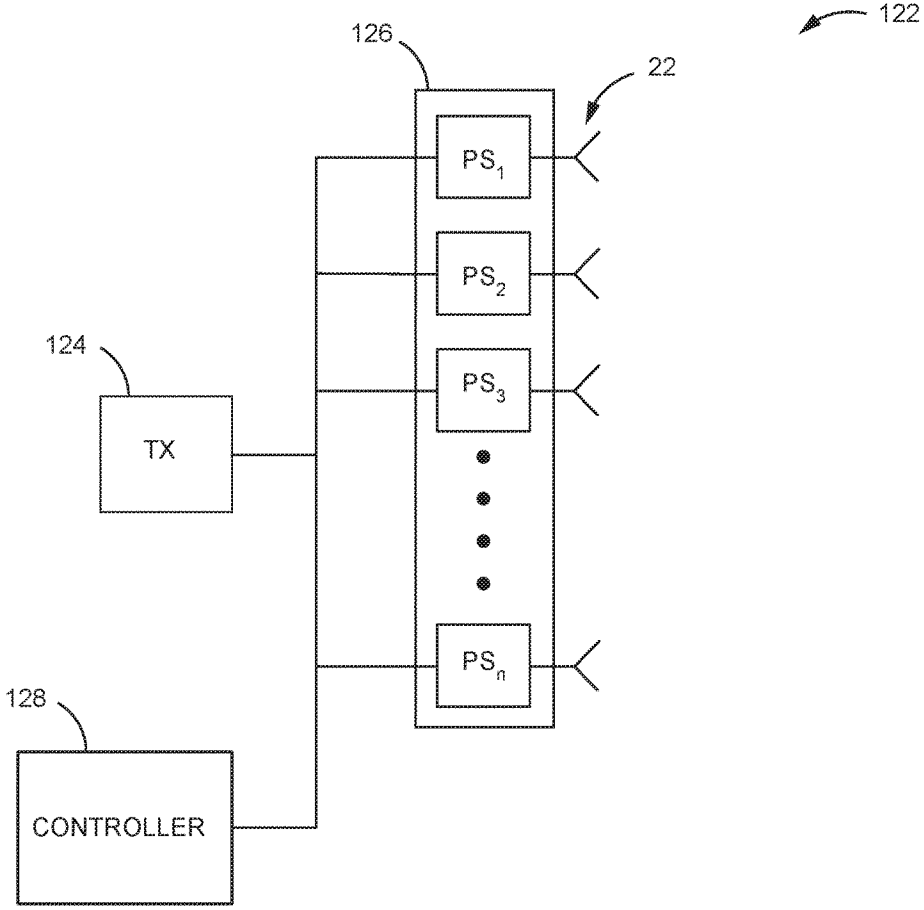
FIG. 10 is a functional block diagram illustrating a phased array antenna system configured according to one aspect of the present disclosure.

FIG. 10 is a functional block diagram illustrating a phased array antenna system 122 configured according to one aspect of the present disclosure. As seen in FIG. 10, the phased array antenna system 122 comprises a plurality of antenna elements 22 distributed across an antenna platter 10, as previously described. Each antenna element 22 is provided with a corresponding feed current by a transmitter 124, with each feed current passing through a corresponding phase shifter 126 controlled by a controller 128.

As is known in the art, the controller 128 controls each of the phase shifters 124 to electronically alter the phase relationship between the feed currents. Such altering causes the radio waves radiated by some of the antenna elements 22 to add together to increase the radiation in a desired direction, while causing the radio waves radiated by the other antenna elements 22 to cancel each other, thereby surpressing the radiation in undesired directions. That is, so controlled, the phased array antenna system 122 is configured for directional radiation.

Figure 11:
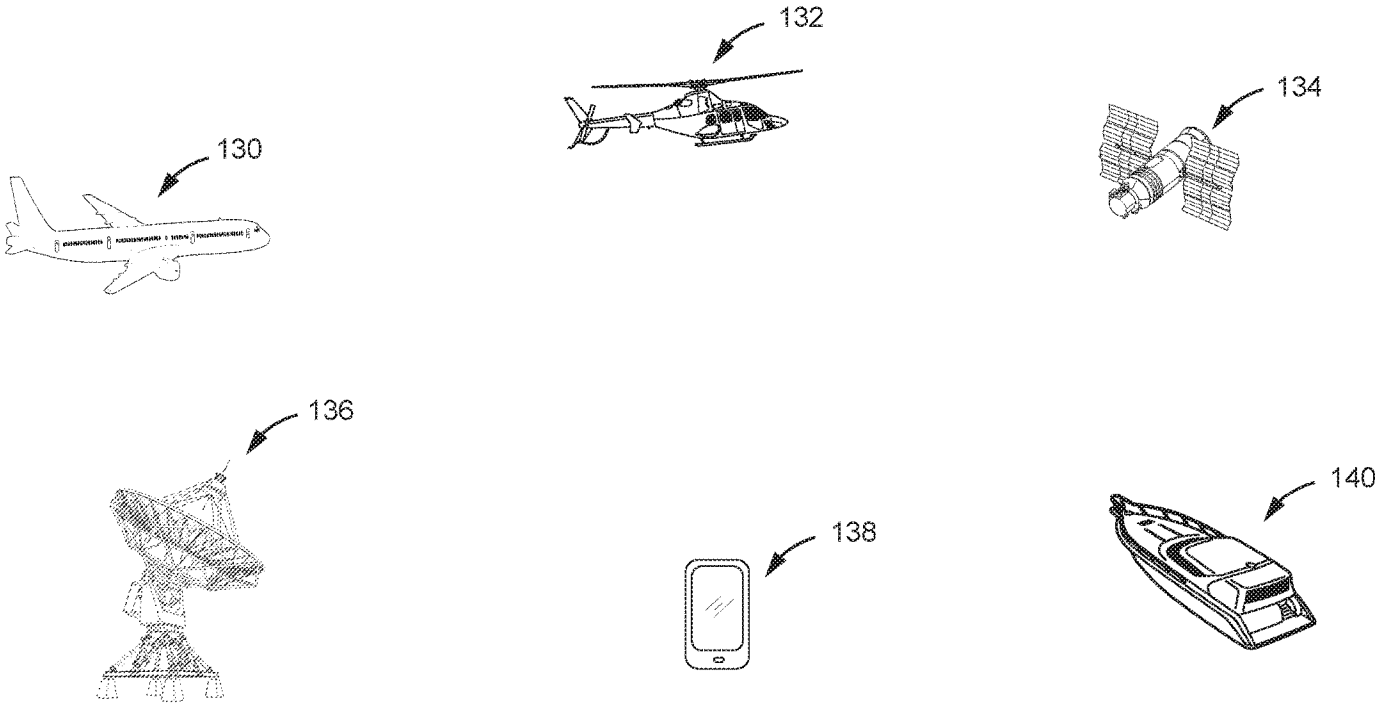
FIG. 11 illustrates some exemplary devices that can utilize an antenna platter configured according to aspects of the present disclosure.

The antenna platter 10 configured according to aspects of the present disclosure is suitable for use in a phased array antenna system 122 associated with any number of different devices. FIG. 11 illustrates such devices as including, but not limited to, aircraft 130, rotorcraft 132, satellites (or other extra-terrestrial vehicles) 134, radar facilities 136, cellular telephones 138, boats 140, and the like.

Aspects of the present disclosure further include various methods and processes, as described herein, implemented using various hardware configurations configured in ways that vary in certain details from the broad descriptions given above. For instance, one or more of the processing functionalities discussed above may be implemented using dedicated hardware, rather than a microprocessor configured with program instructions, depending on, e.g., the design and cost tradeoffs for the various approaches, and/or system-level requirements.

The foregoing description and the accompanying drawings represent non-limiting examples of the methods and apparatus taught herein. As such, the aspects of the present disclosure are not limited by the foregoing description and accompanying drawings. Instead, the aspects of the present disclosure are limited only by the following claims and their legal equivalents.

What is claimed is:

1. A phased array antenna system comprising:

an antenna platter;

a plurality of antenna elements distributed on the antenna platter according to a polygonal grid comprising a plurality of polygonal pairs;

wherein each polygonal pair comprises first and second polygons arranged symmetrically about a center of the antenna platter;

wherein the plurality of antenna elements in each polygon of each polygonal pair is arranged in symmetrical pairs about a center point of the polygon such that the antenna elements of each symmetrical pair are complex conjugates of one another; and wherein the plurality of antenna elements comprise a thinned antenna array, and wherein a density of the plurality of antenna elements on the antenna platter varies as a function of distance from the center of the antenna platter.

2. The phased array antenna system of claim 1 wherein the density of the plurality of antenna elements on the antenna platter decreases as the distance from the center of the antenna platter increases.

3. The phased array antenna system of claim 1 wherein a size and a shape of the first and second polygons of each polygonal pair is the same.

4. The phased array antenna system of claim 3 wherein the first and second polygons of a first polygonal pair are different than the first and second polygons of a second polygonal pair.

5. The phased array antenna system of claim 4 wherein the first polygon of the first polygonal pair and the first polygon of the second polygonal pair have different sizes.

6. The phased array antenna system of claim 4 wherein the first polygon of the first polygonal pair and the first polygon of the second polygonal pair have different shapes.

7. The phased array antenna system of claim 1 wherein the first and second polygons of a first polygonal pair and the first and second polygons of a second polygonal pair, respectively, have the same size and shape.

8. The phased array antenna system of claim 7 wherein a distribution pattern of the antenna elements in the first polygon of the first polygonal pair is the same as a distribution pattern of the antenna elements in the first polygon of the second polygonal pair.

9. The phased array antenna system of claim 1 wherein a distribution of the antenna elements in the first and second polygons of each polygonal pair is a function of a size and a shape of the first and second polygons of each polygonal pair.

10. A method of determining a distribution of antenna elements for a phased array antenna system, the method comprising:

distributing a plurality of antenna elements on an antenna platter according to a polygonal grid that comprises a plurality of polygons arranged in polygonal pairs symmetrically about a center of the antenna platter, wherein distributing the plurality of antenna elements comprises, for each polygon in each polygon pair, arranging the plurality of antenna elements in symmetrical pairs about a center point of the polygon such that the antenna elements of each symmetrical pair are complex conjugates of one another; and thinning the plurality of antenna elements such that a density of the plurality of antenna elements on the antenna platter varies as a function of distance from the center of the antenna platter.

11. The method of claim 10 wherein each symmetrical pair of antenna elements comprises first and second antenna elements, and wherein arranging the plurality of antenna elements in each polygon in symmetrical pairs comprises arranging the first and second antenna elements of each symmetrical pair substantially equidistantly from the center point.

12. The method of claim 10 wherein the density of the plurality of antenna elements on the antenna platter decreases as the distance from the center of the antenna platter increases.

13. The method of claim 10 wherein each polygon pair comprises a first polygon and a second polygon, and wherein the first and second polygons of each polygonal pair are congruent.

14. The method of claim 13 wherein the first and second polygons of a first polygonal pair and the first and second polygons of a second polygonal pair are non-congruent.

15. The method of claim 14 wherein a distribution pattern of the antenna elements in the first polygon of the first polygonal pair is different than a distribution pattern of the antenna elements in the first polygon of the second polygonal pair.

16. The method of claim 10 further comprising determining one or more sets of polygonal pairs in the polygonal grid, wherein a size and shape of the first and second polygons of each polygonal pair in each set are congruent, respectively.

17. The method of claim 16 wherein distributing a plurality of antenna elements comprises distributing the antenna elements in the first polygon of each polygonal pair, and in the second polygon of each polygonal pair, in a same pattern, respectively.

18. A non-transitory computer readable medium storing a computer program product for controlling a programmable computing device, the computer program product comprising software instructions that, when executed by processing circuitry of the programmable computing device, cause the processing circuitry to:

determine a distribution of a plurality of antenna elements on an antenna platter according to a polygonal grid comprising a plurality of polygons arranged in polygonal pairs symmetrically about a center of the antenna platter; and distribute the plurality of antenna elements on the antenna platter, wherein to distribute the plurality of antenna elements, the software instructions, when executed by the processing circuitry, cause the processing circuitry to, for each polygon in each polygon pair, arrange the plurality of antenna elements in symmetrical pairs about a center point of the polygon such that the antenna elements of each symmetrical pair are complex conjugates of one another; and thin the plurality of antenna elements such that a density of the plurality of antenna elements on the antenna platter varies as a function of distance from the center of the antenna platter.

19. The non-transitory computer readable medium of claim 18 wherein each symmetrical pair of antenna elements comprises first and second antenna elements, and wherein to arrange the plurality of antenna elements in symmetrical pairs about a center point of the polygon such that the antenna elements of each symmetrical pair are complex conjugates of one another, the software instructions, when executed by processing circuitry of the programmable computing device, cause the processing circuitry to arrange the first and second antenna elements of each symmetrical pair substantially equidistantly from the center point.

20. The non-transitory computer readable medium of claim 18 wherein the density of the plurality of antenna elements on the antenna platter decreases as the distance from the center of the antenna platter increases.

* * * * *